US005724802A

United States Patent [19]

Foster

[11] Patent Number: 5,724,802

[45] Date of Patent: Mar. 10, 1998

[54] METHOD OF TEXTURING YARN

[75] Inventor: Peter William Foster, Alderley Edge, Great Britain

[73] Assignee: University of Manchester Institute of Science and Technology, Manchester, Great Britain

[21] Appl. No.: 586,922

[22] PCT Filed: Jul. 25, 1994

[86] PCT No.: PCT/GB94/01594

§ 371 Date: Apr. 26, 1996

§ 102(e) Date: Apr. 26, 1996

[87] PCT Pub. No.: WO95/04175

PCT Pub. Date: Feb. 9, 1995

[30] Foreign Application Priority Data

Jul. 28, 1993 [GB] United Kingdom ..... 9315638

[51] Int. Cl.[6] ..... D01H 7/46; D01H 7/92

[52] U.S. Cl. ..... 57/290; 57/264; 57/284; 57/289; 57/333

[58] Field of Search ..... 57/282, 284, 287, 57/288, 289, 290, 333, 264, 350, 351; 28/248, 249

[56] References Cited

U.S. PATENT DOCUMENTS

| | | | |
|---|---|---|---|
| 3,166,881 | 1/1965 | Servage | 57/284 |
| 3,237,392 | 3/1966 | Crouzet | 57/157 |
| 3,626,682 | 12/1971 | Spurgeon | 57/77.3 |
| 3,938,307 | 2/1976 | Hooper | 57/287 |
| 4,014,085 | 3/1977 | Fink et al. | 28/248 |
| 4,398,386 | 8/1983 | Endo et al. | 57/288 |
| 4,456,818 | 6/1984 | McCollough et al. | 57/290 |
| 4,578,940 | 4/1986 | Negishi et al. | 57/288 |
| 5,048,281 | 9/1991 | Dallmann et al. | 57/264 |
| 5,369,945 | 12/1994 | Wessolowski et al. | 57/264 |
| 5,440,870 | 8/1995 | Neumann | 57/284 |
| 5,469,149 | 11/1995 | Binner et al. | 57/264 |
| 5,471,828 | 12/1995 | King | 57/282 |
| 5,502,961 | 4/1996 | Tone et al. | 57/264 |

FOREIGN PATENT DOCUMENTS

| | | | |
|---|---|---|---|
| 2446138 | 4/1976 | Germany | 57/288 |
| 4-343725 | 11/1992 | Japan | 57/264 |
| 2 026 560 | 2/1980 | United Kingdom . | |
| 2037334 | 7/1980 | United Kingdom | 57/288 |
| 2 263 913 | 8/1993 | United Kingdom . | |

*Primary Examiner*—William Stryjewski
*Attorney, Agent, or Firm*—Wallenstein & Wagner, Ltd.

[57] ABSTRACT

There is disclosed a method for false twist texturing comprising the steps of supplying a yarn hot (11) to a twist trap (12) upstream of a false twist device (13) instead of supplying heat to the yarn intermediate the twist trap and the false twist device.

26 Claims, 1 Drawing Sheet

METHOD OF TEXTURING YARN

TECHNICAL FIELD

This invention relates to false twist texturing of yarns.

BACKGROUND OF THE INVENTION

Conventionally, yarns are textured by the false twisting process in a false twist zone which extends from a twist trap that defines the upstream limit of false twist, and contains a heater that raises the temperature of the false twisted yarn, a cooling zone in which the false twisted yarn is cooled, a false twisting device and an output roller arrangement that hauls the yarn through the false twist zone. The yarn may optionally then be wound up as stretch yarn without further processing, though with some relaxation in an overfeed zone to control the wind-up tension, or, with further heat processing in a relaxation zone, to produce a set textured yarn.

The supply yarn may be fully drawn or oriented yarn, or more usually nowadays, partially oriented yarn produced by high speed extrusion from the spinneret, in which case the false twist texturing may involve sequential drawing, in which the yarn is drawn in an in-line operation before passing into the false twist zone or, more usually, simultaneous drawing in which the partially oriented yarn is drawn in the false twist zone itself.

As false twist devices have been developed which operate at higher and higher twisting speeds, the rate at which yarn can be processed—which is limited by the false twisting speed, since false twist texturing requires high rates of twist per unit length—has increased correspondingly. The threadline of a false twisting machine as described is necessarily straight or substantially so—a gently curved heater track can be tolerated—between twist trap and false twist device—and because the twisted yarn must remain in contact with the heater for a certain time in order to reach an effective temperature, the heater has become very long and much ingenuity has been put into the design of false twist texturing machines to cope with the long heaters—which can be several metres in length. Eventually, limitations on practical heater length have limited processing rates. For example, 167 dtex yarn could be false twisted at a speed corresponding to a throughput speed of 1500 metres/minute, but is rarely processed at speeds in excess of 900 metres/minute because of heater limitations.

SUMMARY OF THE INVENTION

The present invention provides a false twist texturing method that avoids such problems.

The invention comprises false twist texturing comprising supplying a yarn hot to a twist trap upstream of a false twist device instead of supplying heat to the yarn intermediate the twist trap and the false twist device.

The yarn may be cooled between the twist trap and the false twist device.

The yarn may pass through a heating zone as an untwisted yarn prior to the twist trap. The heating zone may comprise a Jet heater, which may be supplied with steam and/or hot air. The yarn may be heated in a plug. Jet heaters can operate on untwisted yarn at speeds in excess of 6000 metres/minute.

A feed back control arrangement may be used to control the texturing. The feed back control may comprise a bulk measurement after the false twisting device and which may be effected in a relaxation zone, as by measuring yarn speed or yarn tension in the relaxation zone.

The feed back control may act on a yarn heater, which may be a supplementary yarn heater—that is to say a readily controllable heater that is additional to a primary, uncontrolled heater. The feed back control may, however, act on a yarn hauling device, which may be the output roller of the false twist zone or a false twisting device.

The yarn may be draw-textured. The supply yarn may be taken from a spinneret over a twist trap into a false twisting zone, the heat remaining in the yarn from the spinning operation being sufficient to avoid the need for a separate heating arrangement.

BRIEF DESCRIPTION OF THE DRAWINGS

Embodiments of false twist texturing apparatus and methods according to the invention will now be described with reference to the accompanying drawings, in which.

DETAILED DESCRIPTION OF THE PREFERRED EMBODIMENT

The drawings illustrate false twist texturing comprising supplying a hot yarn 11 to a twist trap 12 upstream of a false twist device 13 instead of supplying heat to the yarn intermediate the twist trap 12 and the false twist device.

It is, of course, to be understood that heat could still, additionally, be supplied to the yarn 11 downstream of the twist trap 12—the invention does not exclude that, but renders it, rather, unnecessary so to do or a matter of choice as to whether and if so how much heat to supply, but in particular renders it unnecessary to use long heaters as are conventionally used. The process however is simplified both from an operating and a control point of view if the conventional twisted yarn heaters are eliminated altogether, as in the embodiments particularly described and illustrated herein and the false twist texturing machine is considerably reduced in capital and operating costs because of the cost savings on providing the heaters and the framework necessary to accommodate them.

Moreover, without such long contact heaters, the machinery can be started and stopped readily. Conventional heaters cannot be so operated without waste of time or yarn before reaching equilibrium temperature. This facility for ready stop/start operation introduces a large measure of flexibility into the operation of the machinery—no longer is it necessary to keep the machinery running on a continuous basis for economic operation, so that single shift or two shift operation becomes viable.

Between the twist trap 12 and the false twisting device 13 is a cooling zone 14—which may simply be an air gap or which may comprise a forced cooling arrangement such as a cold contact block or forced air cooling.

Figure 1:
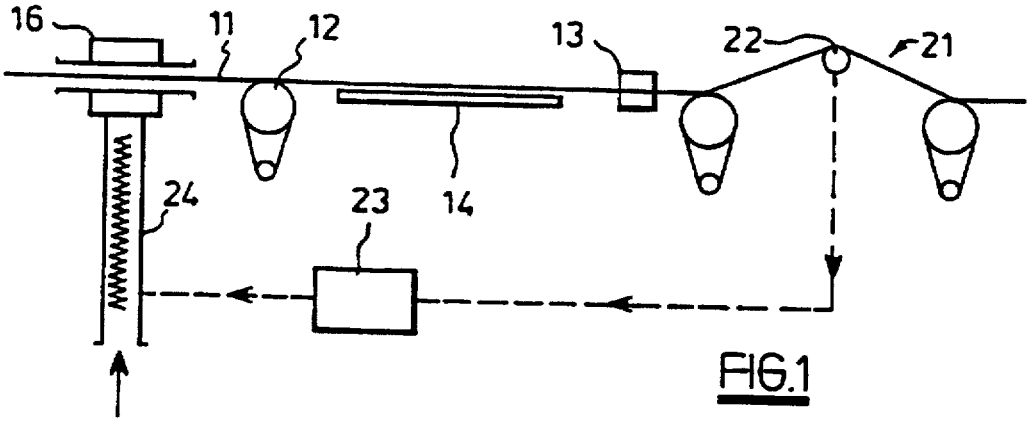
FIG. 1 is a diagrammatic illustration of a first arrangement.
Figure 2:
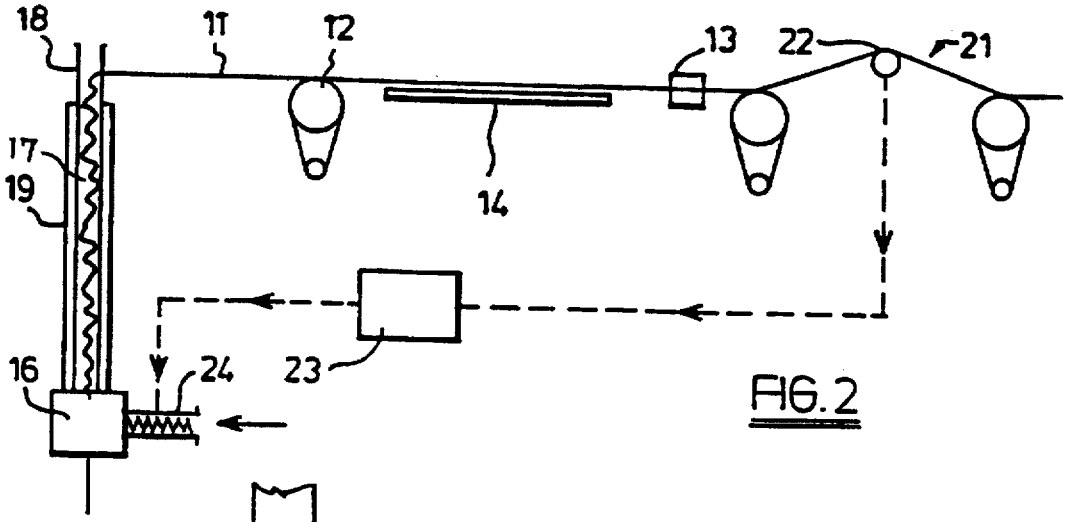
FIG. 2 is a diagrammatic illustration of a second arrangement.

FIGS. 1 and 2 illustrate the yarn 11 passing through a heating step prior to the twist trap 12. In FIG. 2, the yarn 11 is fed by a hot air and/or steam jet 16 into a plug 17 in a tube or plug constraint 18 with a heater jacket 19. Such arrangements are known from other methods of yarn treatment.

In FIG. 1, yarn is supplied through a jet heater 16 without forming a plug. It is desirable, of course, to heat the yarn to such a temperature as will, allowing for any cooling prior to and at the twist trap 12, leave the yarn still at an appropriate temperature for the false twist process. The use of steam, for some yarns at least, enables a lower temperature to be used than if hot air alone is used. The appropriate temperatures are well known from the literature—what does not appear to have been generally recognised hitherto is that such temperatures produced at the twist trap 11 by feeding to it an already hot yarn can suffice for false twist texturing without the need to add post-twist trap heat. Such a suggestion is made in GB-A-2 026 560, but does not appear to have been adopted in practice.

The hot yarn will, of course, heat up the twist trap, but the thermal capacity of the twist trap which will normally comprise a godet roll or a nip roll arrangement may be arranged to be quite small so that equilibrium is rapidly achieved, and indeed the twist trap itself may be heated—heated godets are of course well known in yarn processing.

Figure 3:
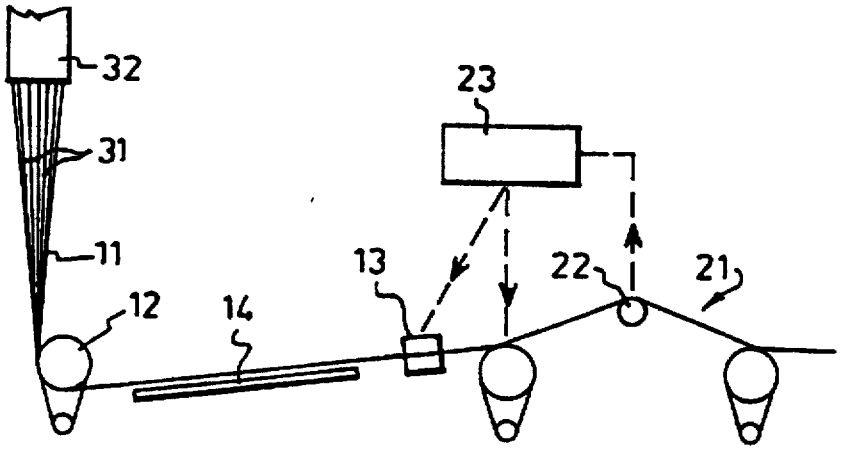
FIG. 3 is a diagrammatic illustration of a third arrangement.

It is, of course, known in yarn texturing and in particular in false twist texturing to have a relaxation zone for the yarn prior to wind—up-in producing set-textured yarn, the relaxation zone includes stretch-relaxing heating. In the embodiments of FIGS. 1 to 3, such a zone 21 is provided in which bulk develops and comprises a bulk measuring device 22 comprising a yarn speed measuring wheel or tension measuring device connected to a feed back control 23 acting on the system to maintain a constant wheel speed and hence bulk.

The feed back control 23, in FIGS. 1 and 2, acts on a supplemental heater 24 for the steam and/or hot air input to the jet heater 16. This effects fine tuning on the yarn temperature at false twisting and is able to control the bulk. The relatively short feed back loop resulting from avoiding the need for the conventional metres-long false twisting heater aids the feed back control operation materially.

FIG. 3 illutrates an arrangement in which freshly spun yarn is supplied to an on-line false twist texturing operation utilising the heat remaining in the yarn from the spinning operation. Filaments 31 from the spinneret 32 are gathered together at the twist trap godet 12 and draw-textured as before. The feed back control 23 is shown as controlling the input godet to zone 21 or alternatively the false twist device 13, but the feed back could operate on the extrusion process as by controlling the cooling chimney or the godet 12.

Any kind of false twist device may be used, but really high speeds are attainable with roller twisting devices of the Positorq (RTM) type.

I claim:

1. A method of making a bulked yarn by false twist texturing a yarn, comprising the steps of:

(a) supplying the yarn through a twist trap to a false twist device so that the yarn is twisted in between the twist trap and the false twist device, but not upstream of the twist trap;

(b) heating the yarn and then cooling the thus twisted yarn before the false twist device;

(c) the yarn being heated before the twist trap so that it is at an elevated temperature, between the twist trap and the false twist device before being cooled while twisted;

(d) controlling the said elevated temperature using a feed back control arrangement wherein the feedback control arrangement comprises:

(1) relaxing tension in the yarn in a relaxation zone downstream the false twist device, so that the false twisted yarn develops bulk;

(2) making a measurement on the yarn representative of the bulk of the yarn thus developed; and (3) controlling the temperature to keep the bulk measurement constant.

2. A method according to claim 1, in which the yarn is heated by a jet heater.

3. A method according to claim 2, in which the jet heater is supplied with steam.

4. Texturing according to claim 2, which the jet heater is supplied with hot air.

5. A method according to any one of claims 1, 2, 3 or 4 in which the yarn is heated in a plug.

6. A method according to any one of claims 2, 3 or 4 in which the starting yarn is a partially oriented yarn and the yarn is drawn during the false twisting step.

7. A method according to claim 6, in which the supply yarn is taken hot from a spinneret over a twist trap.

8. A method according to claim 1, in which the feedback control acts on the false twist device.

9. A method according to claim 1, in which the feedback control acts on a supplementary yarn heater.

10. A method of false twist texturing yarn, wherein the method is controlled by a feedback control arrangement, the method comprising the steps of:

heating the yarn having no false twist to a temperature;

feeding the heated yarn to a twist trap to stop any twist imparted downstream to the twist trap from flowing upstream from the twist trap;

false twisting the heated yarn using a false twist device;

cooling the heated yarn between the twist trap and the false twist device; and removing the yarn from the false twist device at a speed;

wherein the feedback control arrangement controls one of the group selected from the temperature, the speed and the false twist device, in accordance with a measurement representative of yarn bulk made after the false twist device.

11. A method according to claim 10, in which the measurement representative of bulk is a measurement of yarn speed in a relaxation zone.

12. A method according to claim 11, in which the yarn is heated in a main heater and controllable supplementary heater and the feedback control acts on a supplementary yarn heater.

13. A method according to claim 11, in which the feedback control acts on the false twist device.

14. A method according to claim 11 wherein the yarn is removed from the false twist device using a yarn hauling device.

15. A method according to claim 14, in which the feedback control acts on the yarn hauling device.

16. A method according to claim 15, in which the hauling device is an output roller of the false twist zone.

17. A method according to claim 10, in which the yarn is heated by passing through a heating zone prior to the twist trap.

18. A method according to claim 17, in which the heating zone comprises a jet heater.

19. A method according to claim 18, in which the jet heater is supplied with steam.

20. Texturing according to claim 18, in which the jet heater is supplied with hot air.

21. A method according to any one of claims 10, 11, 12 or 14 to 20, in which the yarn is draw-textured.

22. A method according to claim 21, in which the supply yarn is taken hot from a spinneret over a twist trap.

23. A method according to any one of claims 10, 17 to 20, in which the yarn is heated in a plug.

24. A method according to claim 10 further comprising the step of removing yarn from the false twist device using a yarn hauling device that is positioned downstream from the false twist device.

25. A method according to claim 24, in which the feedback control acts on the yarn hauling device.

26. A method according to claim 25, in which the hauling device is an output roller of the false twist zone.

* * * * *

UNITED STATES PATENT AND TRADEMARK OFFICE

CERTIFICATE OF CORRECTION

PATENT NO. : 5,724,802

DATED : March 10, 1998

INVENTOR(S) : Peter William Foster

It is certified that error appears in the above-identified patent and that said Letters Patent is hereby corrected as shown below:

In Column 1, line 59, delete "Jet" and insert therefor --jet--.

In Column 4, line 7, Claim 4, delete "Texturing" and insert therefor --A method--.

In Column 4, line 12, Claim 6, insert --1-- after the word "claims."

In Column 5, line 1, Claim 23, insert --or-- after "claim 10."

Signed and Sealed this

Eleventh Day of August 1998

Bruce Lehman

*Attest:*

BRUCE LEHMAN

*Attesting Officer*

*Commissioner of Patents and Trademarks*